US009192249B2

(12) United States Patent
Schwester et al.

(10) Patent No.: US 9,192,249 B2
(45) Date of Patent: Nov. 24, 2015

(54) INTEGRATED PRODUCT DISPLAY WITH PUSHER ARM

(76) Inventors: Charles P. Schwester, Kinnelon, NJ (US); Ron Sosna, Mendham, NJ (US); Michael Wooters, Hatfield, PA (US)

( * ) Notice: Subject to any disclaimer, the term of this patent is extended or adjusted under 35 U.S.C. 154(b) by 496 days.

(21) Appl. No.: 13/274,466

(22) Filed: Oct. 17, 2011

(65) Prior Publication Data

US 2012/0091079 A1 Apr. 19, 2012

Related U.S. Application Data

(60) Provisional application No. 61/394,093, filed on Oct. 18, 2010.

(51) Int. Cl.
*A47F 1/04* (2006.01)
*A47F 1/12* (2006.01)
*B42F 17/02* (2006.01)

(52) U.S. Cl.
CPC ..... *A47F 1/125* (2013.01)

(58) Field of Classification Search
CPC ..... A47F 1/126; A47F 1/125; A47F 1/128; A47F 5/0025; A47F 5/108; A47F 5/112; B65D 25/101; B65D 5/721; B65D 83/0038; Y10S 206/825; Y10S 206/817
USPC ..... 211/49.1, 50, 59.2, 59.3, 59.4, 51, 54.1, 211/126.16, 128.1, 130.1, 132.1; 206/560, 206/565, 488, 564, 486; 312/71; 221/279
See application file for complete search history.

(56) References Cited

U.S. PATENT DOCUMENTS

| | | | | |
|---|---|---|---|---|
| 2,937,742 | A * | 5/1960 | Michiel | 206/559 |
| 5,111,942 | A * | 5/1992 | Bernardin | 211/59.3 |
| 5,906,283 | A * | 5/1999 | Kump et al. | 211/54.1 |
| 5,988,407 | A * | 11/1999 | Battaglia | 211/51 |
| 6,015,051 | A * | 1/2000 | Battaglia | 211/59.3 |
| 6,082,558 | A * | 7/2000 | Battaglia | 211/59.3 |
| 6,401,942 | B1 * | 6/2002 | Eckert | 211/59.3 |
| 6,749,071 | B2 * | 6/2004 | Caterinacci | 211/40 |
| 7,708,154 | B2 * | 5/2010 | Lang et al. | 211/59.3 |
| 2007/0278164 | A1 * | 12/2007 | Lang et al. | 211/59.3 |

* cited by examiner

*Primary Examiner* — Patrick Hawn
(74) *Attorney, Agent, or Firm* — Sofer & Haroun, LLP

(57) ABSTRACT

A display including a tray having a front side and a back side and two side walls. One or more display compartments are formed within the display. A pusher arm is provided for each of the compartments. Each pusher arm has an upper side and a lower side and is connected on the lower side to the back side of the tray and slidably connected on the upper side to each of the display compartments.

16 Claims, 8 Drawing Sheets

INTEGRATED PRODUCT DISPLAY WITH PUSHER ARM

RELATED APPLICATION

This application claims the benefit of priority from U.S. provisional patent application No. 61/394,093, filed on Oct. 18, 2010, the entirety of which is incorporated by reference.

BACKGROUND

1. Field of the Invention

This application relates to a product display system. More particularly, this application relates to a product display system for commercial packages.

2. Description of Related Art

Retail display shelving is commonly used in grocery stores, department stores, discount stores and other retail outlets to display items. In the prior art, a common display apparatus is a gondola type unit, which typically has a back panel vertically oriented and held in position by connection to at least one upright, which is also vertically oriented. The connection to the upright is accompanied by at least a bottom rail, a center rail and a top rail, although more horizontal rails can be used for this purpose. The vertical uprights are stabilized by at least one and typically two, base legs or brackets. One or more shelves can be horizontally positioned in numerous locations relative to the back panel by virtue of connections between the shelf and the uprights.

A disadvantage of such a system is that these systems require heavy metal parts. Often they are not stackable, combinable units and therefore as stand-alone units, they make inefficient use of the available space.

Displays in the prior art are often made from cardboard or injection molded plastic bases. In order to provide product placement toward the front of the display tray, these cardboard or injection molded bases are typically provided with pusher arms to "push" the product to the front of the display so that product in the system is all up front ready for purchase by the consumer. Typically, such pusher arms are also injection molded plastic and are provided with coil springs to move the product forward.

Displays made from injection molded plastic have numerous disadvantages associated with them:

1) There are many pieces involved that require complicated assembly;

2) They do not stack well and therefore take up a lot of space when shipping; and 3) Injection molding tooling is very expensive and new tooling is required for each product size.

The prior art known to applicants has not effectively overcome the above disadvantages.

OBJECTS AND SUMMARY

The present invention is an inexpensive to manufacture and stackable display unit that likewise, provides a convenient and easy to use display for displaying commercial packages that keeps the commercial packages pressed forward for maximum visibility and aesthetically pleasing display.

To this end, the present invention provides for a display rack including a tray having a front side and a back side and two side walls. One or more display compartments are formed within the tray. A pusher arm assembly is provided for each of the compartments. Each pusher arm has an upper side and a lower side, and is connected on the lower side to the back side of the tray and slidably connected on the upper side to each of the display compartments.

DESCRIPTION OF DRAWINGS

The present invention can be understood through the following description and accompanying drawings, wherein.

DETAILED DESCRIPTION

Figure 1:
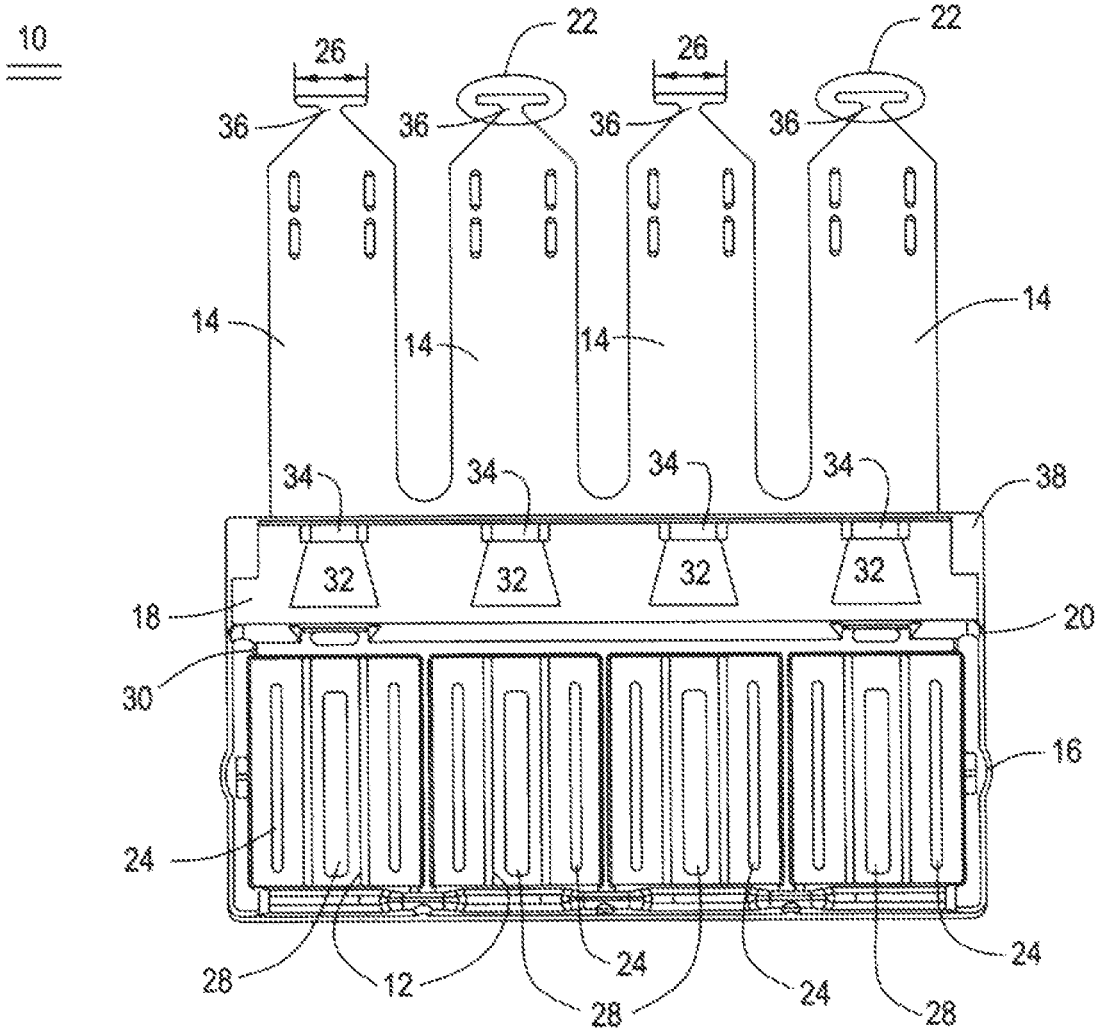
FIG. 1 is a top view of the present invention according to one embodiment.

In accordance with one embodiment, as shown in FIG. 1, a product display 10 is provided for storing commercial products for shipping, display and sale. For the purposes of illustrating the salient features of the present arrangement, product display 10 is configured to display small commercial items such as paper product packages. However, it is understood to those of skill in the art that the present arrangement may be easily adapted to larger or different shaped packages or bottles as desired.

Figure 2:
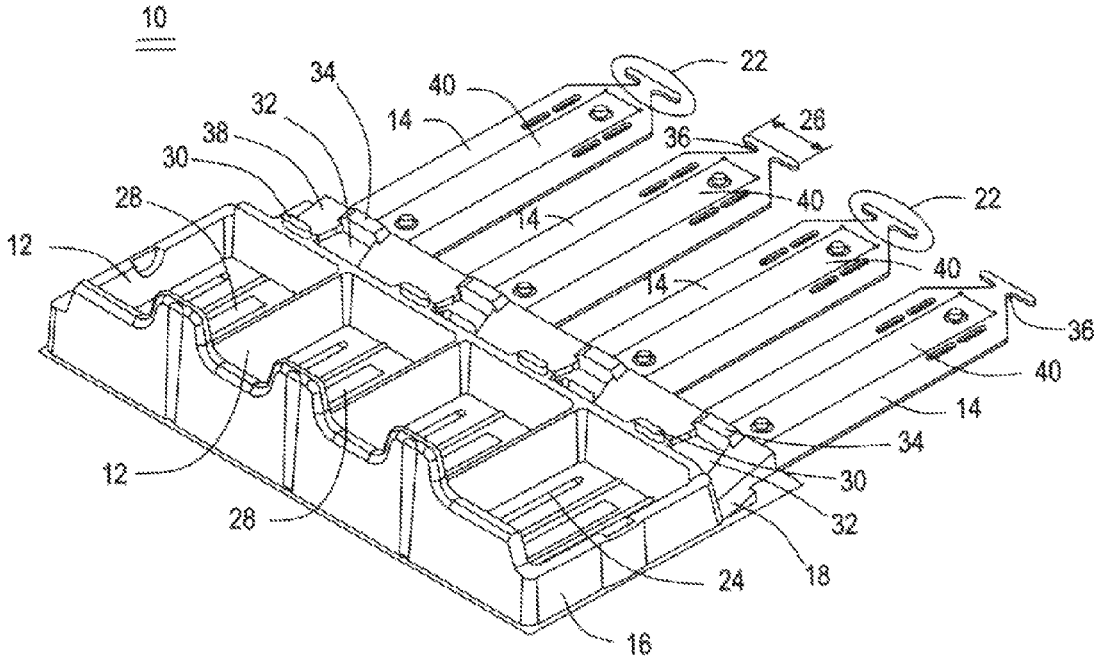
FIG. 2 is a perspective view of the present invention according to one embodiment.
Figure 3:
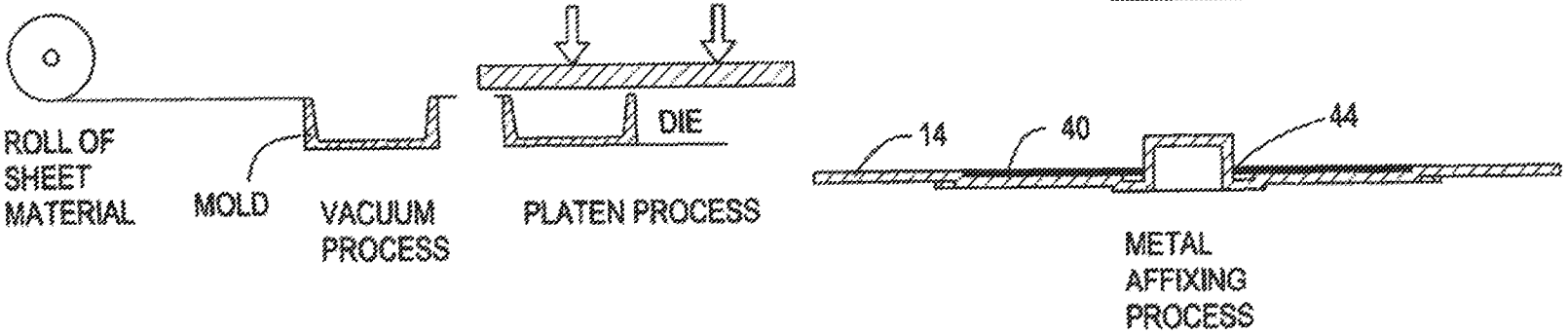
FIG. 3 is a schematic view illustrating the method of production according to one embodiment.

FIGS. 1 and 2 show display 10 in a top view and a perspective view respectively. FIG. 3 shows such display 10 as it is processed from a sheet/roll of polymer.

In this context, as shown in FIG. 3, a polymer sheet, in the form of a roll for example, is obtained from a clear plastic such as PVC (Polyvinyl Chloride) or PET (Polyethylene Terephthalate) sheeting. Once rolled off the roll or cut from sheets, the plastic is vacuum formed or pressure formed under heat, (thermoformed) in a shaped metal mold, into the shapes shown in FIGS. 1 and 2 and described in more detail below. Typically, the plastic is provided in roll stock and cut to length. The plastic used may be 20-80 gauge plastic, but alternative thicknesses may be used as desired. For example, a thicker plastic gauge material may be used for increased spring characteristic as will be explained further below. As shown in FIG. 3, once formed on the mold, a die cutter is used to implement the process of cutting the desired tray 16 as shown in FIGS. 1 and 2. As will be explained hereafter, an additional step of affixing a flat longitudinal metal strip is also shown in FIG. 3, thus providing additional bias to the display 10.

The vacuum formed display 10 formed from this process, prior to placing display 10 into its final configuration described below, may be stacked into multi-unit stacks for easier shipping. For example, the various vacuum shaped elements of display 10 can nest within one another and stack for shipping. In one exemplary embodiment, approximately 25-200 displays 10 may be stacked on one another for shipping within a single shipping carton prior to full assembly. A further advantage of the display formed by this process is that, other than a spring member in the device, the display is formed from a single sheet of material that thus has a one piece unitary design, with all elements of the display being physically attached and ready for assembly when the product is desired to be stored by the manufacturer, shipped by a shipping agent or displayed by a retailer.

Figure 8:
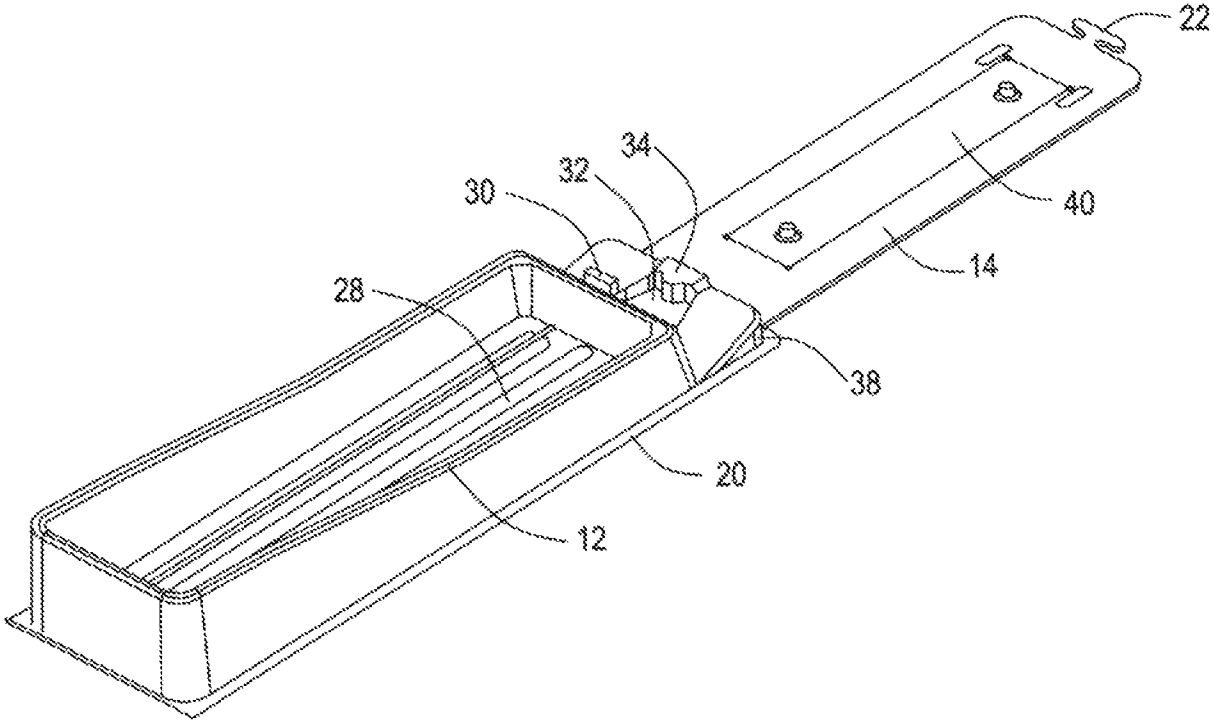
FIG. 8 shows the displays from the above Figures as a single unit design according to an alternative embodiment of the present invention.

Turning to the various the cuts and vacuum formed elements of display 10, as shown in FIG. 1, display 10 has a primary location for receiving the commercial products referred to as tray 16, which includes one or more display compartments 12. FIG. 1 shows four separate display compartments 12, but it is understood that a single compartment 12, as shown in FIG. 8 or any number of compartments are contemplated by the invention. A tab 30 is formed protruding from a back side of tray 16. Score lines which are formed in the vacuum forming process are made within the display compartments 12. In the cutter process, the score lines are cut out to form a channel or opening 28 in each compartment 12, and an insert 22 forming a distal end of each pusher arm 14 and adapted to be received within a corresponding channel or opening. Optionally, raised friction bars 24 which are slightly elevated relative to the bottom of the display compartment 12 are molded within the bottom of the display compartment 12 of tray 16 for the product to rest upon and reduce friction between the product and tray 16 thereby making it easier for the product to move forward in display 10.

Score lines that are formed in the vacuum forming process are made on the second side of the sheet as well. In the cutter process, the score lines are cut out to form product pusher arm 14. The resultant waste material from the roll may then be discarded.

Thereafter, in the metal affixing process shown in FIG. 3, a metal band 40 is affixed to pusher arm 14 with the understanding to those skilled in the art, that any type of method of securing or affixing metal band 40 to pusher arm 14 is contemplated by the invention. For example, metal band 40 may be taped or glued to pusher arm 14. Metal band 40 may be secured to pusher arm 14 by the sandwiching and subsequent heat sealing of an additional layer of plastic material. Or preferably, raised buttons 42 may be formed in the vacuum forming process step on pusher arm 14 so that metal holes 44 punched out of metal band 40 may be aligned with raised buttons 42 so that in an additional crushing step, the raised buttons 42 are heat welded into metal holes 44 by the heat and pressure of the crushing step.

Figure 5:
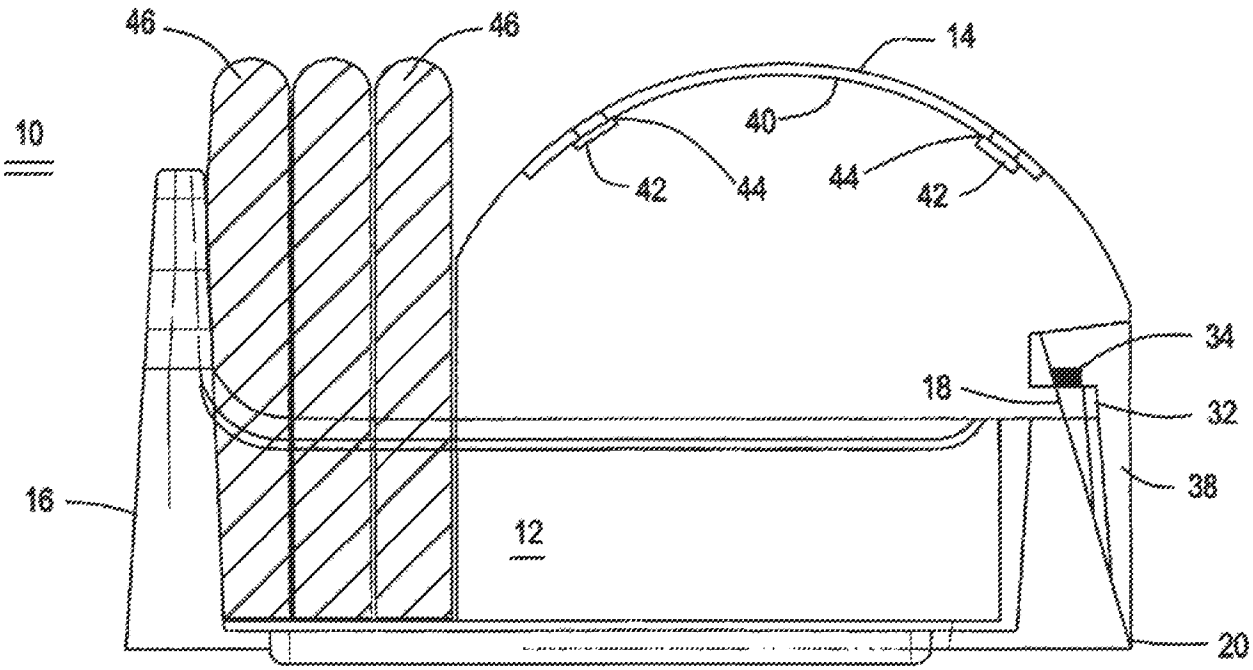
FIG. 5 is a side view of a loaded display compartment according to one embodiment of the present invention.

In order to assemble display 10 and referring to FIGS. 2 and 5, in one arrangement tray 16 also has a flap portion 38 which is connected on its upper end to the lower side of pusher arm assembly 14 and attached at its lower end to tray 16 via hinged connection 20. On this flap portion 38, one or more recesses 32 are vacuum formed, corresponding to the number of display compartments 12 in the display 10. Each of the recesses includes a corresponding downwardly projecting lip 34 protruding at the top thereof. As shown in FIGS. 1 and 2, pusher 14 is attached on its lower end to flap 38. Flap 38 is then attached to tray 16 via an upwardly extending hinged boss 18 which extends along the back side of tray 16. In this configuration, each of the upwardly extending tabs 30 on the back side of tray 16 (one at the rear of each of the compartments 12) is inserted into a cooperating recess 32 on flap 38 and interlocks with downwardly extending lip 34. In this way, flap portion 38 which is initially formed in a generally horizontal position can be folded approximately 90 degrees and locked into a substantially vertical orientation. This ensures that when pusher arms 14 are fully pressed forward towards the front of compartments 12 of tray 16, as will be discussed in more detail below, they maintain their full forward biasing.

Figure 4:
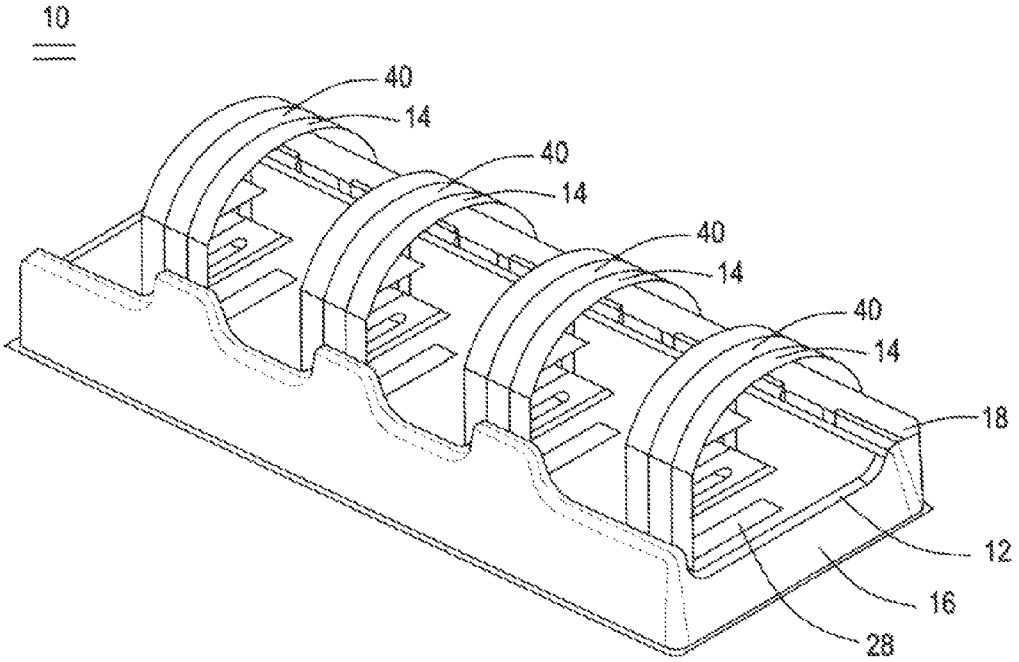
FIG. 4 is a perspective view of the present invention in the assembled state according to one embodiment, without any product therein.

Continuing with the discussion of the setup of display 10, the upper portion of each pusher arm 14 near insert 22 is slidably connected to display compartments 12 by inserting insert 22 into a corresponding channel 28. This is shown in FIG. 4, where the pusher arms 14 are bent into an arc beginning near the back of each compartment 12 and arching forward respectively to the front of each compartment 12. This is repeated for all of the pusher arms 14, each attached to a corresponding display compartment 12. The result is a bowed pusher arm 14 that acts as a spring-bias mechanism built from a single flat roll of vacuum molded and stamped polymer.

Insert 22 is tabbed shaped with the tabs having a greater width, as shown double-headed arrow 26, than the width of opening 28. However, the neck region 36 of insert 22, has a width that is less than the width of opening 28 so that when insert 22 is placed within opening 28, the width of the tabbed insert 22 prevents the insert from being removed from opening 28, with the neck region 36 allowing arm 14 to slide along the length of opening 28 and toward the front of tray 16 as product is removed from display 10. It should be noted that each of the inserts 22, or the arm 14 to which it is attached, is twisted into a position approximately 90 degrees from the orientation illustrated in FIG. 1 to provide the insertion operation.

In order to use display 10, as shown in FIG. 5, one or more products 46 are loaded into display compartments 12 in front of the corresponding pusher arm 14. Pusher arm 14 slides down channel 28 moving backwards so that display compartment 12 is vacated to be filled with product. The pusher arms 14 are biased toward the front of their corresponding display compartment 12 by virtue of the resiliency of the bent polymer from which they are formed. As such, as each product item 46 is removed from a compartment, the pusher arm 14 associated with that compartment slides forward in its respective channel 28, thereby pushing the remaining products forward toward the front of display 10.

As can be understood by those skilled in the art, the force of the spring is dependent on the thickness of the plastic comprising the pusher arm 14 and the polymer used. The thicker the plastic, the greater the force of the spring.

In one embodiment, as shown in FIGS. 4 and 5, in order to improve the resiliency of arm 14, a flat spring-metal bar 40 may be affixed to arm assembly 14 prior to the completion or assembly of display 10 as discussed above with respect to FIG. 3. Also as discussed above, metal bar 40 can be attached to arm assembly 14 by any method of fixation, for example by taping metal bar 40 to arm assembly 14.

In an alternative arrangement, as shown in FIG. 5, for additional strength and resiliency and to ensure that the metal bar 40 remains in place during repeated use, the bar 40 is shown attached to arm assembly 14 via attachment buttons 42.

Figure 6:
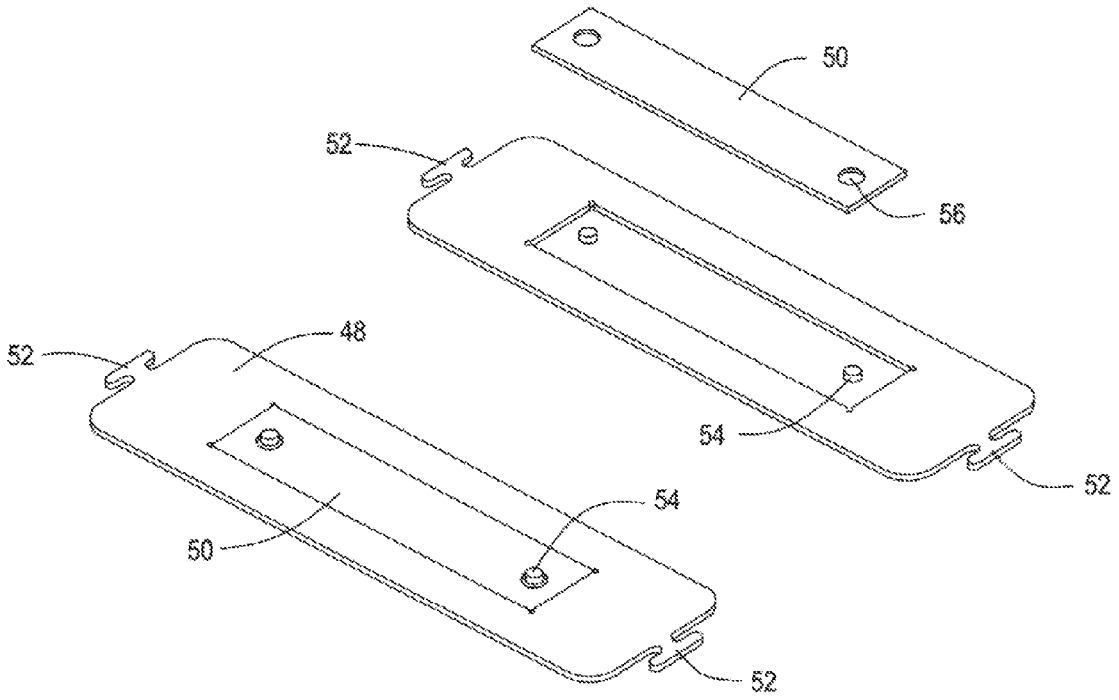
FIG. 6 shows the extension leaf according to an alternative embodiment of the present invention.
Figure 7:
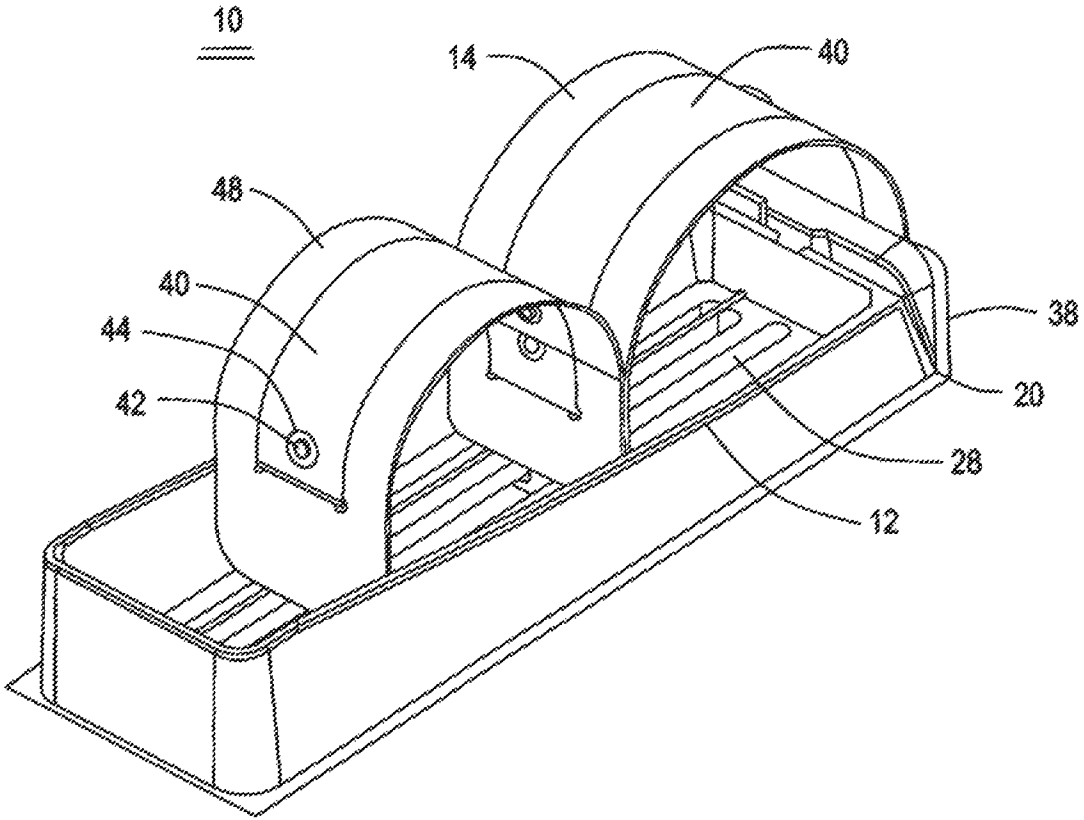
FIG. 7 is a perspective view of the present invention according to one embodiment showing the extension leaf of FIG. 6 assembled in the display.

In another arrangement, as shown in FIGS. 6 and 7, an extension leaf 48 is added for additional strength and stronger spring force. Extension leaf 48 is inserted into display compartment 12 in front of pusher arm 14 in order to add further biasing to the product. Extension leaf 48 has a tab 52 on its upper and lower end; each tab 52 being inserted into opening 28 of compartment 12 when the extension leaf is being employed in the device. Once inserted, extension leaf 48 forms an arc shape similar to pusher arm 14. Metal bars 50 are affixed to extension leaf 48 for additional strength and to improve the spring-biasing action. Metal bars 50 can be affixed by any method including riveting metal bars 50 to extension leaf 48 as shown in FIGS. 6 and 7. Attachment buttons 54 may be formed in the vacuum process step on extension leaf 48 so that metal holes 56 punched out of metal bars 50 may be aligned with buttons 54 so that in an additional crushing step, the buttons 54 are heat welded into metal holes 56 by heat and pressure of the crushing step.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A product display for displaying product, comprising:

a tray having a front end and a back end and two side walls;

a bottom compartment formed within said tray, said tray having an opening;

a flexible pusher arm having an insertion end and an attached end, said attached end connected to the back end of said tray and said insertion end insertable within said opening of said tray with said pusher arm assembly biased toward the front end of said tray; and a flap portion having an upper and a lower end, the upper end of said flap portion connected to the attached end of said pusher arm, said lower end of said flap portion connected via a flexible hinge to the back end of said tray, where said flap portion has a recess with a corresponding tip protruding at the top of said recess, so that when said flap portion is rotated substantially 90 degrees about said flexible hinge, said flap portion is lockably connected via a hinged boss to the back end of said tray.

2. A product display according to claim I, wherein said insertion end of said flexible pusher arm further comprises a tabbed insertion end and a neck portion, said opening having an elongate dimension extending in a direction from the back end to the front end of said tray and a width substantially normal to said elongate dimension, said tabbed insertion end having a width greater than said width of the opening of said bottom compartment tray and said neck portion having a width less than the width of the opening of said bottom compartment tray.

3. A product display according to claim 1 wherein when said flexible pusher arm is attached to said tray, the shape of said attached pusher arm forms an arc which is biased toward the front side of said tray.

4. A product display according to claim 1 wherein the resiliency of said pusher arm is obtained from a polymer material.

5. A product display according to claim 4 wherein the polymer material used is a plastic and wherein the degree of resiliency of said pusher arm is related to the thickness of the plastic.

6. A product display according to claim 1, further comprising a longitudinal metal spring affixed to said flexible pusher arm to provide additional biasing of said pusher arm assembly toward the front end of said tray.

7. A product display according to claim 6, wherein said flexible pusher arm is provided with an attachment button to receive an opening within said metal spring, so that the metal spring is affixed to said pusher arm.

8. A product display according to claim 1, wherein said tray, said bottom compartment and said flexible pusher arm are formed as a unitary member from a single plastic sheet material.

9. A product display for displaying product, comprising:

a plurality of trays having a front end and a back end and two side walls;

a plurality of bottom compartments, each being formed within a respective tray, each of said trays having an opening;

a plurality flexible pusher arms , each pusher arm having an insertion end and an attached end, said attached ends connected to the back end of said trays and said insertion ends insertable within said openings of said trays with said pusher arms biased toward the front end of said trays; and a flap portion having an upper and a lower end, the upper end of said flap portion connected to the attached end of said pusher arms, the lower end of said flap portion connected via a flexible hinge to the back end of said trays of said product display, where said flap portion has recesses with corresponding lips protruding at the top of said recesses, so that when said flap portion is rotated substantially 90 degrees about said flexible hinge, said flap portion is lockably connected via a hinged boss to the back end of said trays.

10. A product display according to claim 9, wherein each of said insertion ends of said flexible pusher arms further comprise a tabbed insertion end and a neck portion, said opening within each tray having an elongate dimension extending in a direction from the back end to the front end of said tray and a width substantially normal to said elongate dimension, said tabbed insertion ends having a width greater than the width of the openings of said trays and said neck portions having a width less than the width of the openings of said trays.

11. A product display according to claim 9 wherein when said flexible pusher arms are attached to said trays, the shape of said attached pusher arms forms an arc which is biased toward the front side of said trays.

12. A product display according to claim 9 wherein the resiliency of said pusher arms is obtained from a polymer material.

13. A product display according to claim 12 wherein the polymer material used is a plastic and wherein the degree of resiliency of said pusher arms is related to the thickness of the plastic.

14. A product display according to claim 9, further comprising longitudinal metal springs affixed to said flexible pusher arms to provide additional biasing of said pusher arms toward the front end of said trays.

15. A product display according to claim 14, wherein said flexible pusher arms are provided with attachment buttons to receive an opening within said metal springs, so that said metal springs are affixed to said pusher arms.

16. A product display according to claim 9 wherein said trays, said bottom compartments and said flexible pusher arms are formed as a unitary member from a single plastic sheet material.

* * * * *